US005683652A

United States Patent [19]

Fünders et al.

[11] Patent Number: 5,683,652

[45] Date of Patent: Nov. 4, 1997

[54] PROCESS FOR REDUCING DUST EMISSIONS OF A BLAST FURNACE

[75] Inventors: Dieter Fünders, Duisburg; Harald Winter, Mönchengladbach, both of Germany

[73] Assignee: L'Air Liquide S.A., Paris Cedex, France

[21] Appl. No.: 474,197

[22] Filed: Jun. 7, 1995

Related U.S. Application Data

[63] Continuation of Ser. No. 310,359, Sep. 21, 1994, abandoned, which is a continuation of Ser. No. 187,660, Jan. 25, 1994, abandoned, which is a continuation of Ser. No. 815,578, Dec. 30, 1991, abandoned, which is a continuation of Ser. No. 477,581, Sep. 9, 1990, abandoned.

[30] Foreign Application Priority Data

Feb. 14, 1989 [DE] Germany ..... 39 04 415.7

[51] Int. Cl.[6] ..... C21B 7/12; C21B 7/14

[52] U.S. Cl. ..... 266/45; 266/196; 222/603

[58] Field of Search ..... 222/590, 603; 266/196, 45; 75/467, 584

[56] References Cited

U.S. PATENT DOCUMENTS 4,666,511 5/1987 Naud ..... 75/51.7

4,723,997 2/1988 Lutgen ..... 75/96

FOREIGN PATENT DOCUMENTS

| | | |
|---|---|---|
| 0071359 | 9/1983 | European Pat. Off. . |
| 0154585 | 9/1985 | European Pat. Off. . |
| 0274290 | 7/1988 | European Pat. Off. . |
| 0288369 | 10/1988 | European Pat. Off. . |
| 0196242 | 4/1989 | European Pat. Off. . |
| 2409097 | 7/1979 | France . |
| 2607829 | 6/1988 | France . |

OTHER PUBLICATIONS

Stahl und Eisen, vol. 103, Nr. 8, 25 Apr. 1983, p. 394, Düsseldorf, Germany; *"Verringerung der Stickstoffaufnahme von flüssigem Stahl in der Pfanne"* (Reduction of nitrogen uptake of liquid steel in the ladle) with translation.

*Primary Examiner*—Scott Kastler

*Attorney, Agent, or Firm*—Oblon, Spivak, McClelland, Maier & Neustadt, P.C.

[57] ABSTRACT

A process for reducing dust emission and free air access in the tapping region of a blast furnace by applying $CO_2$ in a solid and/or gaseous state to the molten material and or the runners and vessels associated therewith. This process reduces dust emissions, nitriding of the product and energy costs associated with conventional dust reduction operations as well as wear of the refractory materials.

4 Claims, No Drawings

PROCESS FOR REDUCING DUST EMISSIONS OF A BLAST FURNACE

This application is a Continuation of application Ser. No. 08/310,359, filed on Sep. 21, 1994, now abandoned, which is a continuation of application Ser. No. 08/187,660, filed Jan. 25, 1994, now abandoned, which is a continuation of application Ser. No. 07/815,578, filed Dec. 30, 1991, now abandoned, which is a continuation application of 07/477,581, filed Feb. 9, 1990, now abandoned.

BACKGROUND OF THE INVENTION

1. Field of the Invention

This invention relates to a process for reducing dust emission and free air access of blast furnaces from the tapping region through the casting bed.

2. Description of the Prior Art

Conventional approaches for tapping a blast furnace to introduce the molten crude iron or ferromanganese into the casting bed are performed in the open air, that is, free air access to the molten material is permitted. Free air access causes several problems. The atmospheric oxygen oxidizes the crude iron or ferromanganese and the resultant oxides rise as pollutants or dust and pollute the air. In addition, some of the carbon released from the crude iron during cooling burns off in the atmospheric oxygen resulting in additional dust emissions.

Further, in order to meet mandated environmental pollution regulations, expensive and energy intensive dust reduction operations must be performed in casting houses. The high speed air blasts required by these operations cause extensive cooling of the crude iron. This results in a permanent thermodynamic supersaturation of the crude iron with carbon which leads to additional dust emission as noted above.

The high air blast speeds and resultant increase in available oxygen causes the carbon in the refractory material in the tapping region to oxidize more quickly, resulting in premature wear. Similarly, the crude iron and ferromanganese are also oxidized more which results in additional dust pollutants that must be extracted.

Liquid nitrogen has been used in the region of the tapping runner in attempts to reduce pollution by preventing free air access. However, liquid nitrogen is extremely cold requiring additional and expensive safety measures for storage and handling. Great care must be taken to prevent excessive cooling of the molten material. The undesired nitriding of the crude iron may reduce the quality of the steel produced.

SUMMARY OF THE INVENTION

The preceding and other shortcomings of the prior art are addressed and overcome by the present invention that provides a process for reducing dust emissions in a runner system between a blast furnace and a casting bed by tapping molten material from a blast furnace through a runner system and applying $CO_2$ to the molten material throughout the runner system to reduce emissions therefrom into the air.

DETAILED DESCRIPTION OF THE PREFERRED EMBODIMENT(S)

The present invention reduces dust and pollutant emission in the tapping region between a blast furnace and the casting bed, and the undesired effects of free air access in this region, without introducing additional atmospheric nitrogen. Carbon dioxide, $CO_2$, in a solid state as $CO_2$ snow and/or in a gaseous state is applied on top of the molten material in the tapping region of the blast furnace. In a particular application, the $CO_2$ may be applied to the molten material to prevent air access in the region of the tapping runner, the downstream rocking runner, the torpedo ladle and/or at least a portion of the casting bed. The $CO_2$ may be applied directly to the molten material and/or to these runners and vessels before and/or during contact with the molten material.

A convenient technique for applying the $CO_2$ in a solid state, or as a mixture of solid and gaseous states, is the use of one or more guns for charging, and/or precharging the tapping region with $CO_2$. The $CO_2$ may be applied to the tapping region at the time of, or just before, the application of the molten material. In particular, it may be convenient to charge the system with $CO_2$ in the same sequence as the molten material. That is, the $CO_2$ would be applied to the tapping region in the following sequence: the tapping runner, rocking runner, torpedo ladle and/or the casting bed.

In the region of the tapping runner or runners, including both iron or slag runners, the $CO_2$ may be applied in a combined solid and gaseous mixture by means of a special gun, both directly on the tapping side and at several points along the runner. The $CO_2$ snow floats on the molten material up to the entrance to the rocking runner. As the $CO_2$ snow vaporizes, additional $CO_2$ gas is continually released into the atmosphere reducing the partial pressures of atmospheric oxygen and nitrogen. The exclusion of air can readily be controlled and adjusted in accordance with the conditions at the time by the use of varying amounts of $CO_2$ snow.

In the region of the rocking runner, the surface area of the molten material is increased many times as the material is transferred from the tapping runner to the rocking runner by the casting jet. The surface area also increases substantially as the molten material is transferred from the rocking runner to the torpedo ladle. In conventional processes, these increases in surface area have resulted in a substantial intensification of undesired oxidation, dust and pollution emissions and nitriding of the molten material. In accordance with the present invention, however, gaseous $CO_2$ replaces atmospheric oxygen and nitrogen as the $CO_2$ snow is applied simultaneously to both the molten material within the rocking runner and to the casting jet from the crude iron runner to the rocking runner.

The flow of molten material from the casting jet into the torpedo ladle causes intense turbulence associated with the very large increase in surface area of the molten material with results similar to those noted above. By replacing the entire atmosphere within the torpedo ladle with $CO_2$, it is possible to substantially reduce or even eliminate oxidation and nitriding. In addition to applying $CO_2$ to the surface of the molten material, it is convenient to apply $CO_2$ snow as a bottom layer of the ladle to provide a reservoir of $CO_2$ for the duration of a tap and ensure that the atmosphere therein is substantially depleted of oxygen and nitrogen.

The flow of molten material in the pouring region from the torpedo ladle to the casting bed also results in the intense turbulence phenomena noted above. This region as a rule is located in the open air without any convenient pollution control mechanisms and generates substantial dust emissions. Stricter environmental restrictions are expected for this region in the future. The combined use of $CO_2$ snow and gas, especially if both the casting chamber and the entire casting bed are protected thereby from air free access, can provide substantial improvement in the reduction of pollution by dust emission.

In accordance with the present invention, the expenses associated with conventional dust reduction operations may be substantially reduced or even eliminated. The same result is true for other mandated pollution reduction expenses. Similarly, the energy costs associated with such operations as well as the investments for structures such as casing and the like can be dramatically reduced. Expenses involved in configuring a system for use with the present invention, such as the partial fitting of extraction hoods, is relatively small when compared with the costs associated with conventional dust reduction operations and/or conventional measures for reducing or preventing oxidation and/or undesired nitriding of the product.

As noted above, the use of $CO_2$ in accordance with the present invention substantially reduces not only the dust emissions associated with the tapping region of a blast furnace but also the nitriding of the molten material and the addition wear of refractory material. The substantial reductions in down time for relining and repair dramatically reduces costs and extends service life and capacity.

While this invention has been described with reference to its presently preferred embodiment(s), its scope is not limited thereto. Rather, such scope is only limited insofar as defined by the following set of claims and all equivalents thereof.

What is claimed is:

1. A process for reducing dust and fume emissions from a runner system of a blast furnace into an ambient atmosphere during the transfer of molten metal from a blast furnace to a casting bed, comprising:

a) tapping molten metal from a blast furnace through an unenclosed runner system in open air to the casting bed;

b) maintaining a layer of gaseous $CO_2$ on top of the molten metal throughout the unenclosed runner system by charging the top surface of the molten metal with a mixture of solid and gaseous $CO_2$ with a plurality of guns both directly on the tapping side and at several points along the runner;

whereby the vaporization of the solid $CO_2$ into gaseous $CO_2$ in the vicinity of the top surface of the molten metal further reduces dust emissions from the molten metal; and wherein said molten metal is selected from the group consisting of crude iron and ferromanganese.

2. The process of claim 1, wherein said solid $CO_2$ consists essentially of $CO_2$ snow.

3. The process of claim 1, which further comprises replacing an entire atmosphere within a torpedo ladle in said runner system, downstream of a tapping runner and upstream of the casting bed, with $CO_2$, by applying $CO_2$ snow to a bottom layer of said ladle and $CO_2$ to the surface of the molten metal in said ladle.

4. The process of claim 1, which is conducted without introducing additional atmospheric nitrogen.

* * * * *

UNITED STATES PATENT AND TRADEMARK OFFICE

CERTIFICATE OF CORRECTION

PATENT NO. : 5,683,652

DATED : November 4, 1997

INVENTOR(S) : Dieter FÜNDERS et al.

It is certified that error appears in the above-identified patent and that said Letters Patent is hereby corrected as shown below:

On the title page, Item [63], the Related U.S. Application Data should read:

-- Continuation of Ser. No. 310,359, Sep. 21, 1994, abandoned, which is a continuation of Ser. No. 187,660, Jan. 25, 1994, abandoned, which is a continuation of Ser. No. 815,578, Dec. 30, 1991, abandoned, which is a continuation of Ser. No. 477,581, Feb. 9, 1990, abandoned. --

Signed and Sealed this

Thirteenth Day of January, 1998

Bruce Lehman

*Attest:*

BRUCE LEHMAN

*Attesting Officer*

*Commissioner of Patents and Trademarks*